US008881862B1

(12) United States Patent
Messer, Jr. et al.

(10) Patent No.: US 8,881,862 B1
(45) Date of Patent: Nov. 11, 2014

(54) SPLIT CORE FIRE ARM SUPPRESSOR

(71) Applicants: John B. Messer, Jr., Taylor, TX (US); David N. Mucha, Jr., Taylor, TX (US)

(72) Inventors: John B. Messer, Jr., Taylor, TX (US); David N. Mucha, Jr., Taylor, TX (US)

( * ) Notice: Subject to any disclaimer, the term of this patent is extended or adjusted under 35 U.S.C. 154(b) by 0 days.

(21) Appl. No.: 13/964,619

(22) Filed: Aug. 12, 2013

(51) Int. Cl.
*F41A 21/30* (2006.01)

(52) U.S. Cl.
CPC ..... *F41A 21/30* (2013.01)
USPC ..... 181/223; 89/14.4

(58) Field of Classification Search
CPC ..... F41A 21/30
USPC ..... 181/223; 89/14.4
See application file for complete search history.

(56) References Cited

U.S. PATENT DOCUMENTS

| | | | |
|---|---|---|---|
| 4,576,083 | A | 3/1986 | Seberger, Jr. |
| 4,584,924 | A | 4/1986 | Taguchi |
| 4,588,043 | A | 5/1986 | Finn |
| 7,587,969 | B2 | 9/2009 | Silvers |
| 8,307,946 | B1 | 11/2012 | Johnston |
| 2012/0279798 | A1 | 11/2012 | Kline et al. |

*Primary Examiner* — Jeremy Luks
(74) *Attorney, Agent, or Firm* — Michael A. Ervin; M. A. Ervin & Associates

(57) ABSTRACT

A separable and cleanable split core firearm suppressor that can be easily disassembled into two separate cores after use and easily cleaned, then reassembled for use.

3 Claims, 4 Drawing Sheets

SPLIT CORE FIRE ARM SUPPRESSOR

CROSS-REFERENCE TO RELATED APPLICATIONS

Not applicable.

FIELD OF THE INVENTION

The present invention generally relates to firearms and similar devices, and in particular to an apparatus for suppressing the muzzle blast, attendant noise, and visible signature of a discharging firearm for the purposes of reducing detectability and/or for protecting hearing and doing so with a suppressor design that is easily separated into component parts for easy cleaning.

BACKGROUND

Suppressors for firearms, also known as silencers, generally operate to reduce the audible noise or sharp report of a firing weapon by means of reducing and controlling the energy level of attendant propellant gases. Generally, the techniques employed utilize a series of baffles which control and delay the flow, expansion, and exiting of propellant gases, forcing the propellant gases to pass through various temperature absorbent materials, or a combination of these or functionally similar techniques to reduce the temperature and abrupt discharge of propellant gases. The result achieved is a corresponding reduction in the noise produced by the exiting propellant gases.

A number of prior art patents have addressed different solutions to the issue of reducing the sharp report of a firing weapon. Most tend to be composed of a series of baffles that inhibit the passage of propellant gases while allowing the passage of a projectile. These baffles can be rather simple flat disks with a cutout for the bullet passage or can be more complex cone or funnel shapes. Some of the more successful ones are known as "K" or "M" baffles because of their resemblance to those letters.

Some example approaches can be seen in U.S. Pat. Nos. 4,576,083; 4,584,924; 4,588,043; 7,587,969; and 8,307,946.

Frequent use of such suppressors or silencers over time results in the buildup of byproduct from the debris of the exploding propellant gases. Because of the tight tolerances inherent in the design to suppress noise these suppressors can become very dirty from carbon, dirt, and unburned powder. Cleaning is possible but difficult—often requiring the pumping of solvents through the suppressor. There is a need then for a design that is much easier to clean.

SUMMARY

This need is addressed with separable split core firearm suppressor assembly including at least: a split core base having a longitudinal axis and having a front end having a circular exit opening and a rear end having a circular entrance opening with a threaded piece on the rear end, the split core base having milled a geometry of milled out pockets comprised of multiple angled surfaces that obstruct and deflect propellant gases; a split core cap having a longitudinal axis, and having milled out pockets comprised of multiple angled surfaces that obstruct and deflect propellant gases; the split core base and the split core cap each having geometries that when mated together form multiple gas chamber and port configurations and provide a central pathway for projectile and propellant gases to pass through and ultimately exit the circular exit opening of the front end of the split core base; an outer cylindrical housing that slides over the mated split core base and split core cap; a threaded insert for attaching the split core firearm assembly to a host device; and a threaded cap for attaching the outer cylindrical housing to the split core assembly.

DETAILED DESCRIPTION

In the following detailed description, reference is made that illustrate embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken in a limited sense, and the scope of the disclosure is defined only by the appended claims.

Figure 1:
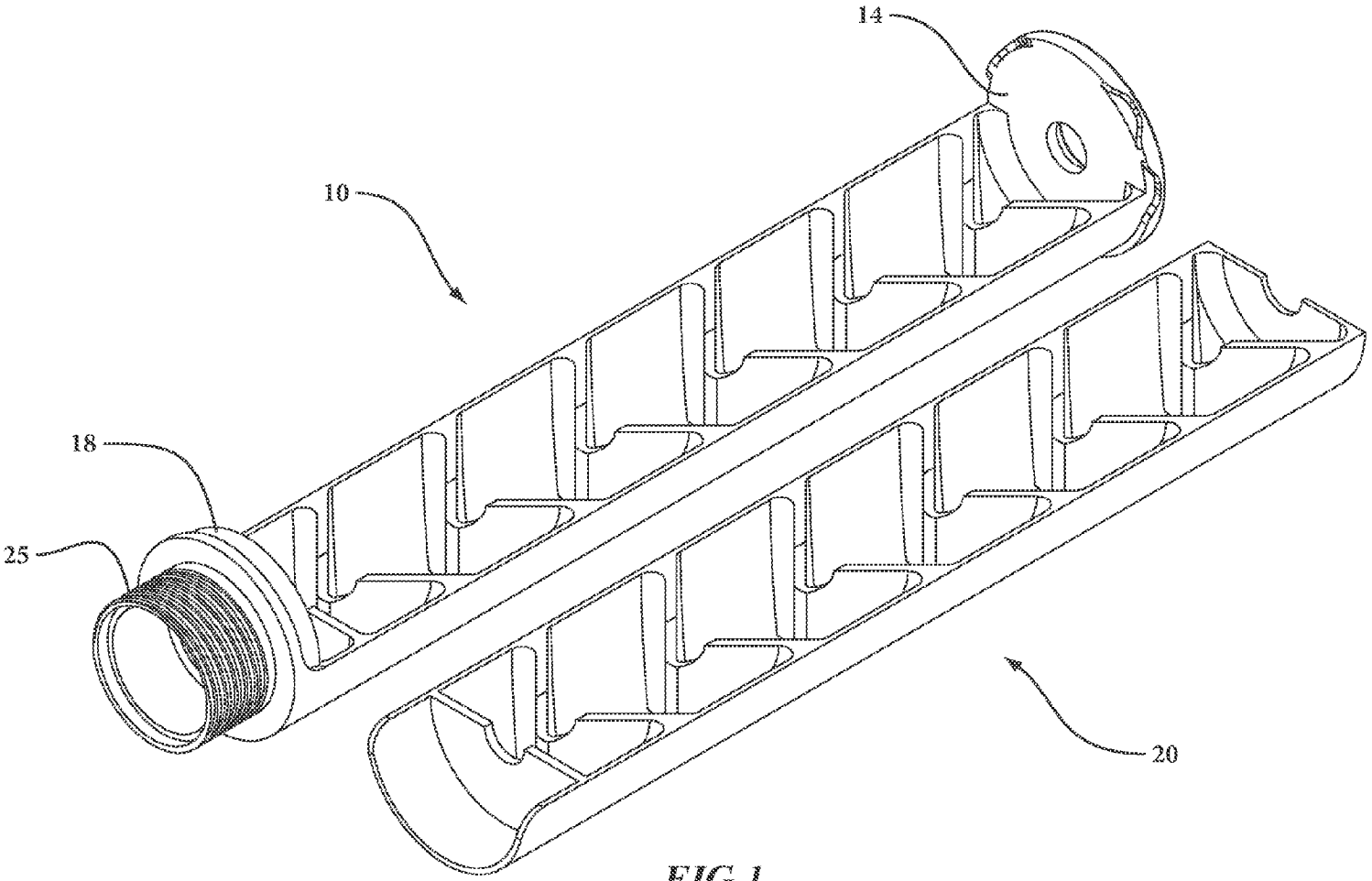
FIG. 1 illustrates the split core base and the split core cap of an embodiment of this disclosure.

In FIG. 1 we see key elements of the split core firearm suppressor. A split core base 10 with a front end 14 and a back end 18 having a threaded piece 25 on back piece 18. Shown alongside split core base 10 is a split core cap 20, which when rotated and mated on top of split core base 10 forms a complete set of multiple gas chamber and port configurations. The geometry created by the interior space of the split core is positioned to control the flow of the propellant gasses and the temperatures associated with the gasses therefore reducing the sound emitted from the host device. The split core base has milled out pockets comprised of multiple angled surfaces that obstruct and deflect the propellant gasses. The split core cap also has milled out pockets comprised of multiple angled surfaces that obstruct and deflect the propellant gasses.

Figure 2:
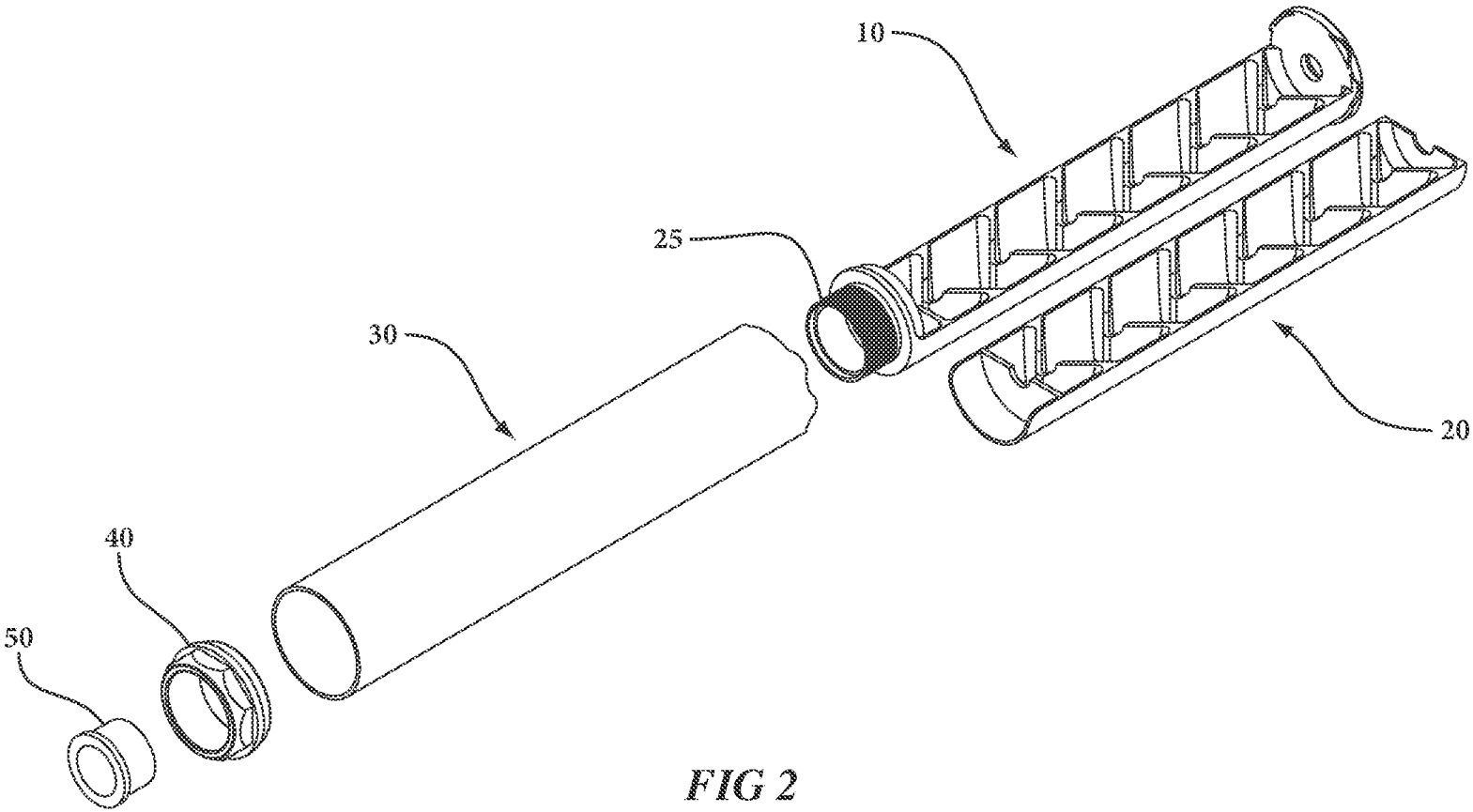
FIG. 2 illustrates the disassembled pieces of the split core firearm suppressor.

FIG. 2 illustrates additional disassembled pieces of the split core firearm suppressor. Split core base 10 and split core cap 20 are again shown separately (before mating). Once mated the combined split core 10, 20 is inserted into cylinder 30, which totally encloses the mated split core assembly combination. After that insertion the thread piece 25 extends from the end of the cylinder 30 and a threaded cap 40 and threaded insert 50 is applied to complete the split core assembly. The threaded cap attaches the outer cylindrical housing to the split core assembly. The threaded insert is for attaching the complete split core firearm assembly to the host firearm.

Figure 3:
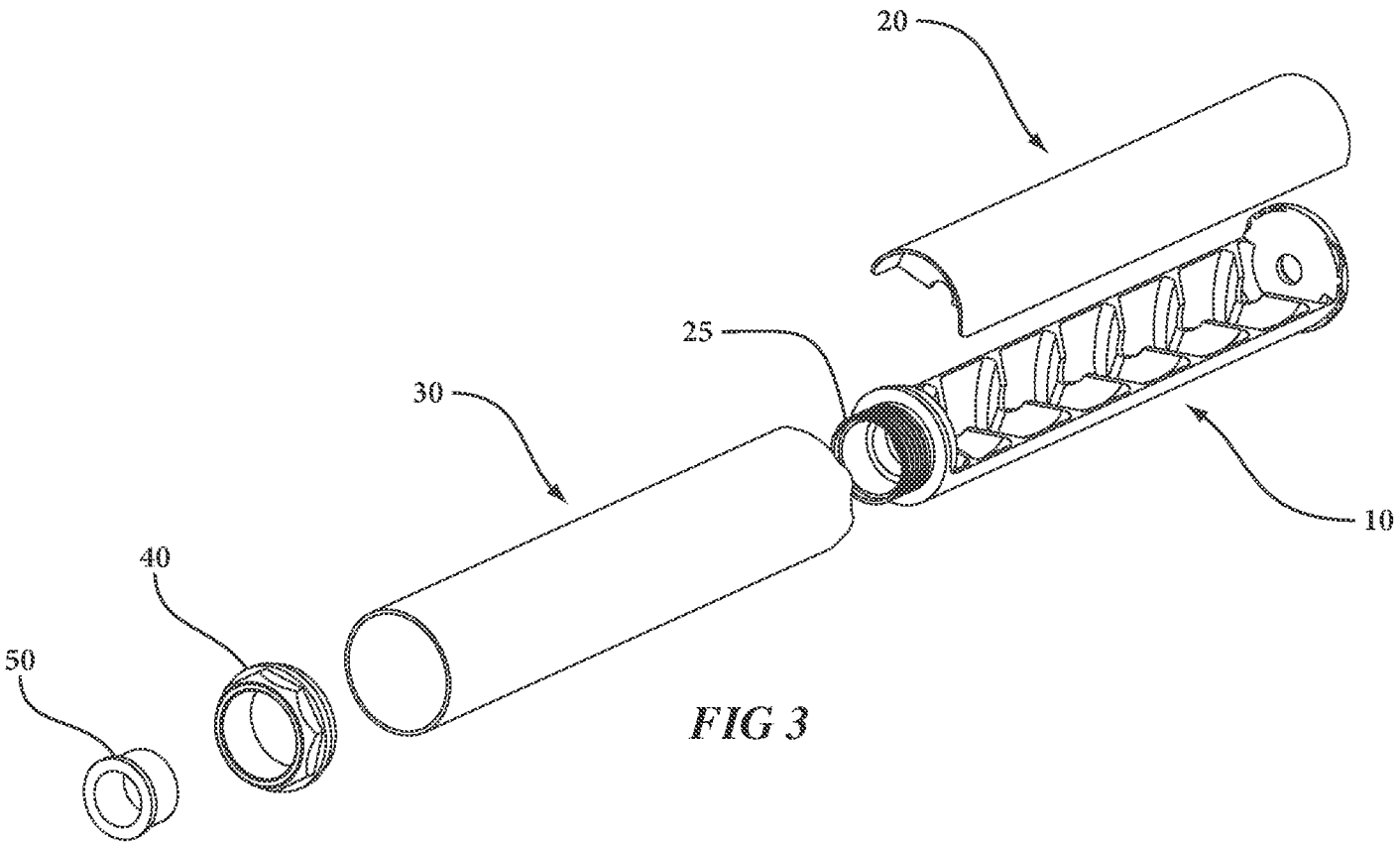
FIG. 3 illustrates an alternate view showing the placement of the split core top onto the split core base before assembly.

In an alternate view, FIG. 3 illustrates the split core cap 20 now in position for mating to split core base 10. The geometries of the split core base and the split core cap allow a fit of the two in only one direction.

Figure 4:
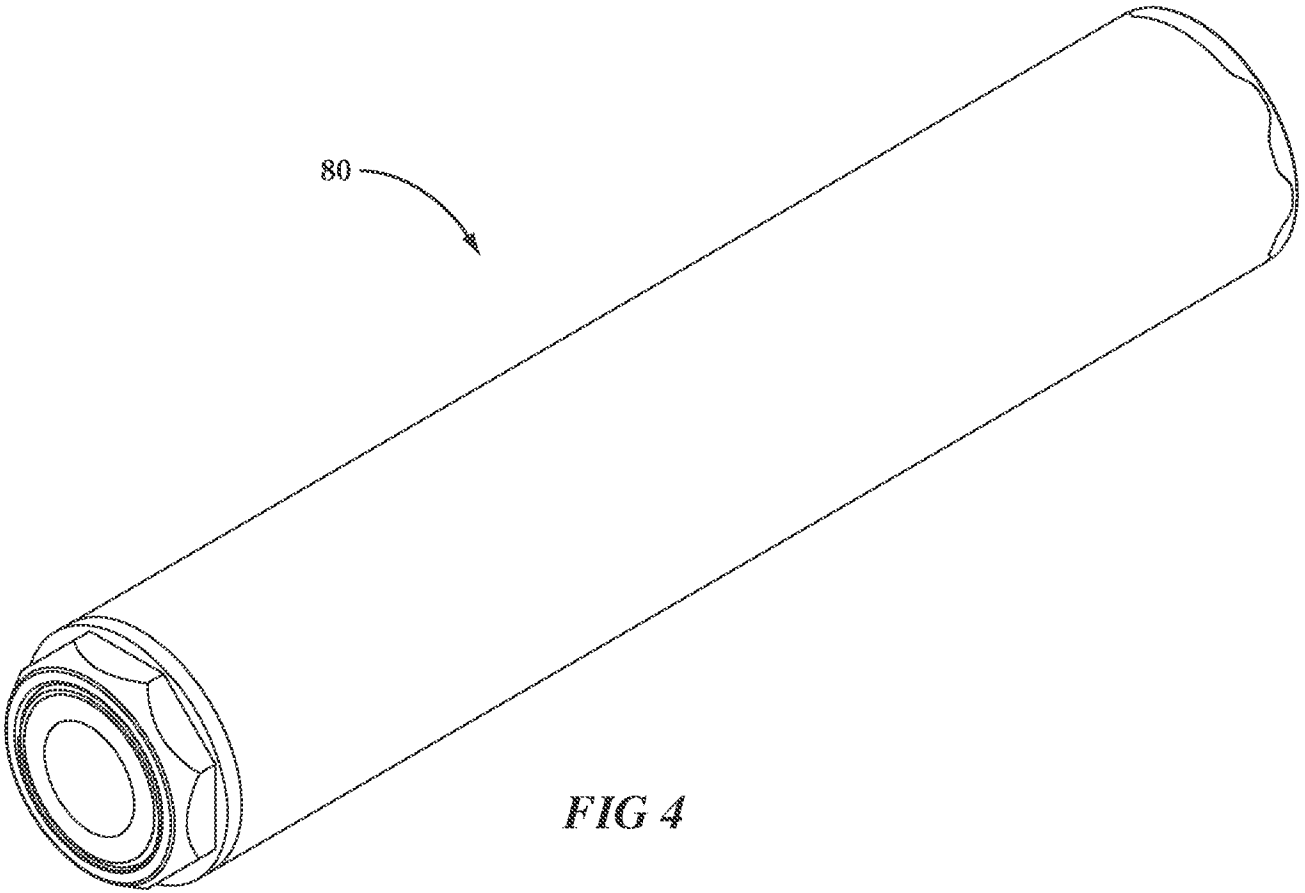
FIG. 4 illustrates an assembled view with the split core firearm suppressor now inside the cylinder and the threaded cap in place.

Finally FIG. 4 illustrates the fully assembled split core firearm suppressor assembly 80.

When the split core base and split core cap are mated inside the cylindrical housing a hole concentric with the outer housing is formed to create a pathway for the projectile and propellant gasses to pass through and ultimately exit the end of the split core base. The split core functionality enables its removal from the cylindrical housing and the ability to separate the split core base and the split core cap for complete access to clear all gas chambers and ports from any debris and buildup that would alter the performance of the suppressor or host device. The split core base 10 has two important diameters, one equivalent to the cylindrical housing outside diameter and the other equivalent the inside diameter of the cylindrical housing.

Although certain embodiments and their advantages have been described herein in detail, it should be understood that various changes, substitutions and alterations could be made without departing from the coverage as defined by the appended claims. Moreover, the potential applications of the disclosed techniques is not intended to be limited to the particular embodiments of the processes, machines, manufactures, means, methods and steps described herein. As a person of ordinary skill in the art will readily appreciate from this disclosure, other processes, machines, manufactures, means, methods, or steps, presently existing or later to be developed that perform substantially the same function or achieve substantially the same result as the corresponding embodiments described herein may be utilized. Accordingly, the appended claims are intended to include within their scope such processes, machines, manufactures, means, methods or steps.

The invention claimed is:

1. A separable split core firearm suppressor assembly comprising:

a. a split core base having a longitudinal axis and having a front end having a circular exit opening and a rear end having a circular entrance opening with a threaded piece on the rear end, the split core base having milled a geometry of milled out pockets comprised of multiple angled surfaces that obstruct and deflect propellant gases;

b. a split core cap having a longitudinal axis, and having milled out pockets comprised of multiple angled surfaces that obstruct and deflect propellant gases;

c. said split core base and said split core cap each having geometries that when mated together form multiple gas chamber and port configurations and provide a central pathway for projectile and propellant gases to pass through and ultimately exit the circular exit opening of the front end of the split core base;

d. an outer cylindrical housing that slides over the mated split core base and split core cap;

e. a threaded insert for attaching the split core firearm assembly to a host device; and f. a threaded cap for attaching the outer cylindrical housing to the split core assembly.

2. The separable split core firearm suppressor assembly of claim 1 wherein the geometries of the split core base and the split core cap allow a fit of the two in only one direction.

3. A method for providing an easily cleanable firearm suppressor comprising:

a. providing a split core base having a longitudinal axis and having a front end having a circular exit opening and a rear end having a circular entrance opening with a threaded piece on the rear end, the split core base having milled a geometry of milled out pockets comprised of multiple angled surfaces that obstruct and deflect propellant gases;

b. providing a split core cap having a longitudinal axis, and having milled out pockets comprised of multiple angled surfaces that obstruct and deflect propellant gases;

c. combining said split core base and said split core cap each having interior geometries that when mated together form multiple gas chamber and port configurations and provide a central pathway for projectile and propellant gases to pass through and ultimately exit the circular exit opening of the front end of the split core base;

d. providing an outer cylindrical housing that slides over the mated split core base and split core cap;

e. providing a threaded insert for attaching the split core firearm assembly to a host device; and f. providing a threaded cap for attaching the outer cylindrical housing to the split core assembly.

* * * * *